US010745997B2

(12) United States Patent
Burris et al.

(10) Patent No.: US 10,745,997 B2
(45) Date of Patent: Aug. 18, 2020

(54) TUBING PRESSURE INSENSITIVE FAILSAFE WIRELINE RETRIEVABLE SAFETY VALVE

(71) Applicants: John Burris, Bixby, OK (US); Jason Edwards, Broken Arrow, OK (US)

(72) Inventors: John Burris, Bixby, OK (US); Jason Edwards, Broken Arrow, OK (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 16/001,604

(22) Filed: Jun. 6, 2018

(65) Prior Publication Data

US 2019/0376367 A1 Dec. 12, 2019

(51) Int. Cl.

| | |
|---|---|
| ***E21B 34/14*** | (2006.01) |
| ***E21B 34/06*** | (2006.01) |
| ***E21B 34/10*** | (2006.01) |
| *E21B 34/00* | (2006.01) |

(52) U.S. Cl.

CPC ..... *E21B 34/14* (2013.01); *E21B 34/063* (2013.01); *E21B 34/10* (2013.01); *E21B 2034/005* (2013.01)

(58) Field of Classification Search

CPC ..... E21B 34/14; E21B 34/063; E21B 34/10; E21B 2034/005

See application file for complete search history.

(56) References Cited

U.S. PATENT DOCUMENTS

| | | | | |
|---|---|---|---|---|
| 4,325,431 | A * | 4/1982 | Akkerman | E21B 23/03 166/117.5 |
| 4,393,930 | A * | 7/1983 | Ross | E21B 33/1294 166/188 |
| 4,658,902 | A * | 4/1987 | Wesson | E21B 34/063 166/317 |
| 6,125,930 | A * | 10/2000 | Moyes | E21B 34/066 166/317 |
| 6,269,874 | B1 * | 8/2001 | Rawson | E21B 34/066 166/53 |
| 7,694,742 | B2 * | 4/2010 | Bane | E21B 34/10 166/332.1 |
| 9,810,343 | B2 * | 11/2017 | Miller | F16K 31/1223 |
| 2006/0086509 | A1 * | 4/2006 | McMillan | E21B 34/10 166/386 |
| 2008/0110611 | A1 * | 5/2008 | Bane | E21B 34/10 166/53 |
| 2008/0128137 | A1 * | 6/2008 | Anderson | E21B 34/101 166/319 |

(Continued)

*Primary Examiner* — James G Sayre
*Assistant Examiner* — Aaron L Lembo
(74) *Attorney, Agent, or Firm* — Cantor Colburn LLP

(57) ABSTRACT

A tubing pressure insensitive failsafe wireline retrievable safety valve including a tool housing, a flow tube disposed within the tool housing, an actuation piston disposed in the tool housing and operably connected to the flow tube, the actuation piston having an actuation pressure side and a relatively lower pressure chamber side, a fluid pathway between a potential leak site for the valve and the relatively lower pressure chamber side of the piston. A borehole system having a tubing pressure insensitive failsafe wireline retrievable safety valve. A tubing pressure insensitive failsafe wireline retrievable safety valve.

1 Claim, 2 Drawing Sheets

(56) References Cited

U.S. PATENT DOCUMENTS

| | | | | |
|---|---|---|---|---|
| 2008/0314599 | A1* | 12/2008 | Bane | E21B 23/04 166/375 |
| 2010/0116502 | A1* | 5/2010 | Anderson | E21B 34/102 166/321 |
| 2016/0138365 | A1* | 5/2016 | Vick, Jr. | E21B 34/14 166/375 |
| 2018/0334883 | A1* | 11/2018 | Williamson | E21B 34/102 |

* cited by examiner

TUBING PRESSURE INSENSITIVE FAILSAFE WIRELINE RETRIEVABLE SAFETY VALVE

BACKGROUND

Safety valves (SCSSV) are well known components of the hydrocarbon recovery and other subsurface resource recovery industries. So too are replacement safety valves such as tubing retrievable safety valves (TRSV) and wireline retrievable safety valves (WRSV) that may be disposed within an original or another replacement safety valve if necessary. Operation of the TRSV and WRSV tools can be through the original control line running to the original SCSSV by penetrating a fluid chamber fed by that original control line. While the replacement TRSV and WRSV tools work well, there are some circumstances where they can fail in the open position. Such as WRSV's that operate with less applied pressure than wellbore pressure. Since such failure is unacceptable, the tools must be maintained on a more regular basis to avoid that concern. Hence they can be more costly to operate than desired. The art then will welcome tools having a longer operational life before maintenance.

SUMMARY

A tubing pressure insensitive failsafe wireline retrievable safety valve including a tool housing, a flow tube disposed within the tool housing, an actuation piston disposed in the tool housing and operably connected to the flow tube, the actuation piston having an actuation pressure side and a relatively lower pressure chamber side, a fluid pathway between a potential leak site for the valve and the relatively lower pressure chamber side of the piston.

A borehole system having a tubing pressure insensitive failsafe wireline retrievable safety valve including a tool housing, a flow tube disposed within the tool housing, an actuation piston disposed in the tool housing and operably connected to the flow tube, the actuation piston having an actuation pressure side and a relatively lower pressure chamber side, a fluid pathway between a potential leak site for the valve and the relatively lower pressure chamber side of the piston.

A tubing pressure insensitive failsafe wireline retrievable safety valve including a tool housing, a flow tube disposed within the tool housing, a failure piston disposed in the tool housing and fluidly coupled to an opening and a port that are segregated during use from ambient fluid by first seals and second seals respectively, the piston configured to vent to a chamber upon a selected pressure from the opening and/or the port acting on the failure piston.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
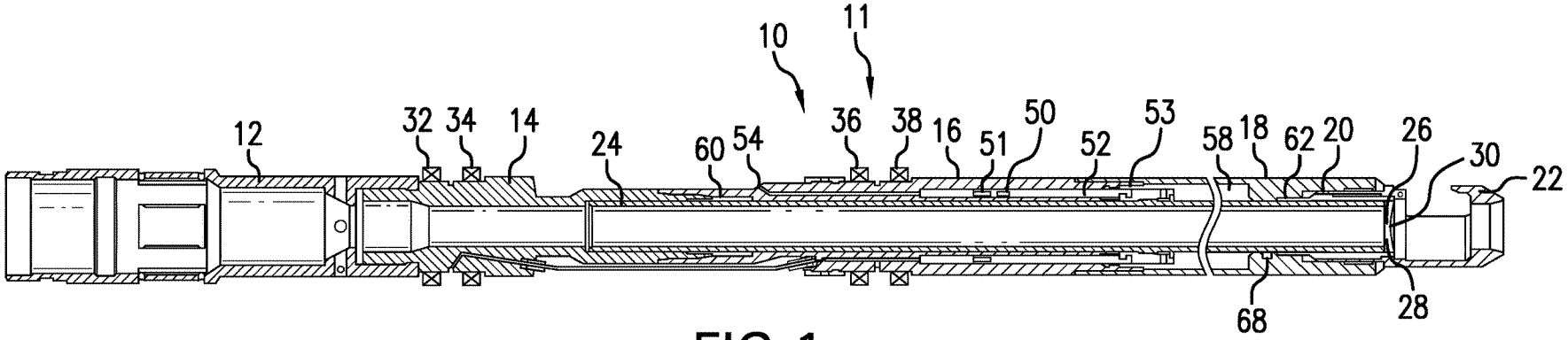
FIG. 1 is a cross sectional view of a WRSV as taught herein in a closed position.
Figure 2:
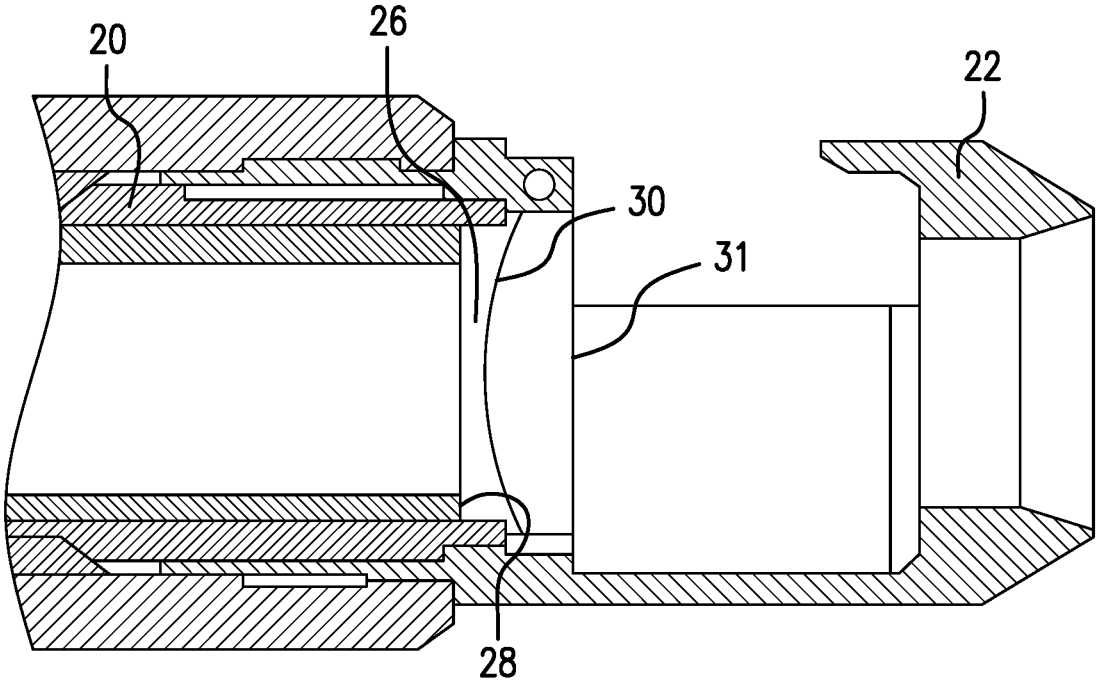
FIG. 2 is an enlarged view of a portion of FIG. 1 including the flapper housing.

Referring to FIG. 1, a WRSV 10 is illustrated in a closed position. The WRSV 10 is configured specifically to fail closed rather than open to remove undesirable operating conditions and additional maintenance procedures. The WRSV 10, arbitrarily starting at the uphole end of the tool, exteriorly comprises a tool housing 11 having top sub 12, a spacer sub 14, a piston housing 16, a spring housing 18 a flapper seat 20 and a flapper housing 22. A flow tube 24 is disposed slidingly within the tool housing 11 and specifically within the spacer sub 14, the piston sub 16, the spring housing 18 and the flapper housing 22. The flow tube generally works as all flow tubes in safety valves do but as described herein the flow tube 24 is configured to define a space 26 between an end 28 of the flow tube 24 and a flapper 31 having a seat 30 (see FIG. 2). The space 26 provides for stroke of the flow tube 24 before the flapper 31 would be forced open. This is unusual since conventional wisdom would dictate that the flow tube immediately contact the flapper 31 to open the same in order to shorten the overall actuation stroke requirements of the tool. Not so in the tubing pressure insensitive failsafe wireline retrievable safety valve as disclosed herein. The flow tube end 28 is constructed to be as disclosed in order to provide stroke of other components as well as the flow tube 24 itself so that the failsafe nature of the tool is realized. This will become clearer hereunder.

Continuing with the construction of the WRSV 10, at the outside diameter of the WRSV 10 are first seals 32, 34, and second seals 36, 38 that are sealable against a seal bore of a preexisting tubular (not shown) that may be an SCSSV, for example. The positioning of a WRSV within an SCSSV is well known to the art and need not be shown or described further herein. Between seals 32 and 34 is an opening 40 that leads to a conduit 42 connected to a failure piston 44 disposed within housing 11. The conduit 42 may be within the housing 11 or may be a separate tubular structure connected to the housing 11 or may be both (as shown) so long as it provides a fluid pathway to the piston 44. The conduit 42 is also intersected by a port 46 disposed in housing 11 between seals 36/38. Constructed as such, fluid leaking past any of seals 32, 34, 36, 38 will be communicated to the conduit 42 and thence to the piston 44. Piston 44 includes a seal ring 48. It is to be appreciated that the seal ring 48 is much farther to the right in the drawing than another seal ring 50 disposed upon an actuation piston 52. This is important to function of the WRSV 10 and will become clearer upon the discussion of operation below. The piston 52 is operable to move the flow tube 24 from a closed position to an open position (illustrated in FIG. 3) upon pressure input through inlet 54 to an actuation side 51 of piston 52. It will be appreciated by one of ordinary skill in the art that for a WRSV of this general type, the SCSSV hydraulic control system is accessed (e.g. by cutting) which causes hydraulic fluid to flood the annular volume defined between the seals 34 and 36. Hence added pressure in this annular volume will increase pressure on actuation side 51 of piston 52 causing that piston to actuate the flow tube and accordingly, the flapper 31 in normal use operations. It is also important to note that the spring housing 18 defines a relatively lower pressure chamber 58, such as an atmospheric chamber. Chamber 58 is defined within spring housing 18, piston housing 16, flow tube 24, failure piston 44 with seal 48, piston 52 with seal 50 and two additional seals 60 and 62 on the flow tube 24. Incidentally, it is this atmospheric chamber that allows for reduced pressure requirements to actuate the WRSV 10. The piston 52 at an opposite side from the actuation side 51 defines relatively lower than ambient pressure side 53. Because the piston 52 experiences a delta pressure between the actuation fluid and the relatively lower pressure chamber, it does not need to overcome wellbore pressure to actuate the flow tube 24.

During normal operation, increased pressure at 54 will cause piston 52 to urge the flow tube 24 toward the flapper 31 forcing the flapper 31 to open and decreased pressure at 54 will allow the flow tube 24 to move to the closed position under impetus of a power spring (that is housed in the atmospheric chamber 58 but is not shown for simplicity reasons), which power spring works in the conventional manner.

Leaks at any of seals 32, 34, 36, 38 would traditionally have potentially created a fail open situation by allowing wellbore pressure to access inlet 54 and pressurize the piston 52 actuation side 51 to a level greater than the relatively lower pressure side 53 but as configured in accordance with the teaching herein, the WRSV 10 is failsafe even with leaks at any of seals 32, 34, 36, 38. This is because regardless of which seal 32, 34, 36 or 38 begins to leak, pressure will necessarily find its way to opening 40 or port 46, and will ultimately be communicated via pathway 47 (which comprises in the figure for example only opening 40, port 46, conduit 42 and relatively lower pressure chamber 58 with the option of failure piston 44 being disposed within the pathway 47) to the relatively lower pressure side 53 of piston 52. In this condition the valve 10 will always fail closed. All failure modes result in higher pressure on the relatively lower pressure side 53 of the actuation piston 52 or that the pressure across piston 52 is static. There never is a scenario where the pressure applied by wellbore fluid will increase pressure on the actuation side 51 of piston 52 more than the predetermined differential from the pressure on the relatively lower pressure side 53 of the piston 52. The possibilities are that one of seal 32 or 38 have failed allowing wellbore pressure to reach opening 40 or port 46 which is then communicated through pathway 47 to the relatively lower pressure side 53 of piston 52 resulting in closure; or that wellbore pressure has also reached the inlet 54 such that the pressure on the side 53 is identical to the pressure on the side 51 (caused by failure of both 32, 34 or 36, 38) and the power spring takes over and closes the WRSV 10.

Figure 3:
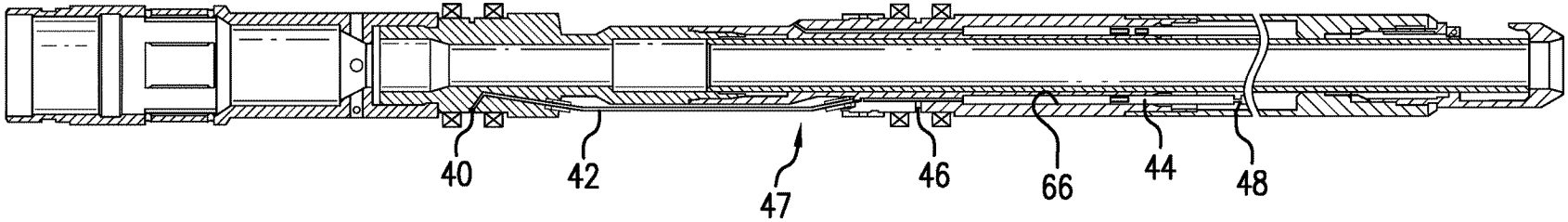
FIG. 3 is a cross sectional view of a WRSV as taught herein in an open position.

In an embodiment as illustrated, pressure coming through seals 32, 34, 36 or 38 will be communicated through conduit 42 to piston 44. That pressure will cause piston 44 to move the flow tube 24 toward the flapper 31 but recall the space 26. The stroke capability of the flow tube 24 before the flapper 31 is contacted and begins opening, that stroke being caused by piston 44 is greater than the stroke available to piston 44 before the seal 48 leaves the seal bore 66, which position is illustrated in FIG. 3. Once the seal 48 leaves the seal bore 66, the piston 44 is no longer capable of moving the flow tube 24. And since the chamber 58 is at atmospheric pressure (or in any event at a significantly lower pressure than ambient wellbore pressure), the fluid (e.g. wellbore fluid) that was formerly segregated by seal 48 and causing the piston 44 to move is now fluidly communicated with the chamber 58. The leaking fluid will consequently simply drain into chamber 58. To the extent the chamber 58 becomes pressurized with the leaking fluid, that pressure is communicated to the lower pressure side 53 as noted above. This means that leaking fluid cannot create a pressure head on any piston that is capable of shifting the flow tube 24 to the open position due to a leak at any of seals 32, 34, 36, 38 and the WRSV 10 necessarily fails closed.

Since it is often the case that seals 32, 34, 36, 38 would fail slowly rather than catastrophically, the WRSV 10 also is useful to provide feedback to surface as to its own condition. This is because as fluid pressure rises in the atmospheric chamber 58, the pressure required on the original control line (not shown but as discussed acting on piston 52) must be raised to keep the WRSV 10 open. This increasing pressure requirement can be registered at surface (or other control position) to determine that at least one of the seals 32, 34, 36, 38 may be leaking and maintenance or replacement is warranted. In addition, the fact that the piston 44 is mechanically connected to the flow tube 24 means that a sudden failure of the seals 32, 34, 36 or 38 will cause the flow tube 24 to rapidly change position. The change in position of flow tube 24 will cause a pressure spike in the control line that may be registered at a remote control location, e.g. surface.

Finally, it is noted that while running the WRSV 10 to its target deployed location, the seals 32, 34, 36, 38 are not set and the opening 40 and port 46 are open to wellbore fluid, which naturally increases in pressure with increasing depth. The increasing pressure will mimic a leak of the set seals as described above. In extreme cases, the chamber 58 could be filled with wellbore fluid before the tool is even set, rendering the tool useless although still failed in the closed position. Hence it is desirable in some embodiments or for some utilities that the flow tube 24 be releasably retained for run in. This may be carried out by a release member 68 such as a shear member that may be released by applied pressure on piston 52. Alternatively, it may be desirable to configure the running tool with a retaining appendage similar to an internal fishing grapple to physically hold the flow tube 24 in position for the running operation. The grapple may then be released once the WRSV 10 is set.

The WRSV 10 is contemplated to be a part of a borehole system having for example a tubular string running into a subsurface environment, the string possibly including an SCSSV the function of which may need to be replaced by the WRSV 10 described herein.

Set forth below are some embodiments of the foregoing disclosure:

Embodiment 1

A tubing pressure insensitive failsafe wireline retrievable safety valve including a tool housing, a flow tube disposed within the tool housing, an actuation piston disposed in the tool housing and operably connected to the flow tube, the actuation piston having an actuation pressure side and a relatively lower pressure chamber side, a fluid pathway between a potential leak site for the valve and the relatively lower pressure chamber side of the piston.

Embodiment 2

The valve as in any prior embodiment, wherein the fluid pathway comprises a failure piston disposed between the potential leak site and the relatively lower pressure side of the piston.

Embodiment 3

The valve as in any prior embodiment, wherein the failure piston includes a seal positioned to exit a bore in which the failure piston is disposed prior to the flow tube contacting a flapper, in use.

Embodiment 4

The valve as in any prior embodiment, wherein the flow tube includes an end defining a space between itself and a flapper, the space dimensioned to ensure that the fluid communicates fluid pressure therein to the relatively lower pressure side of the piston prior to the flow tube contacting the flapper.

Embodiment 5

The valve as in any prior embodiment, wherein the valve further includes a relatively lower than ambient pressure chamber.

Embodiment 6

The valve as in any prior embodiment, wherein the chamber is partially defined by seals between the housing and the flow tube.

Embodiment 7

The valve as in any prior embodiment, wherein the chamber is an atmospheric chamber.

Embodiment 8

The valve as in any prior embodiment, wherein the fluid pathway includes an opening and a port both fluidically connected to a conduit, the conduit in pressure communication with the failure piston.

Embodiment 9

The valve as in any prior embodiment, wherein the flow tube and the housing are releasably connected together by a release member.

Embodiment 10

The valve as in any prior embodiment, wherein the release member is a shear member.

Embodiment 11

A borehole system having a tubing pressure insensitive failsafe wireline retrievable safety valve including a tool housing, a flow tube disposed within the tool housing, an actuation piston disposed in the tool housing and operably connected to the flow tube, the actuation piston having an actuation pressure side and a relatively lower pressure chamber side, a fluid pathway between a potential leak site for the valve and the relatively lower pressure chamber side of the piston.

Embodiment 12

The valve as in any prior embodiment, wherein the potential leak site is a seal.

Embodiment 13

A tubing pressure insensitive failsafe wireline retrievable safety valve including a tool housing, a flow tube disposed within the tool housing, a failure piston disposed in the tool housing and fluidly coupled to an opening and a port that are segregated during use from ambient fluid by first seals and second seals respectively, the piston configured to vent to a chamber upon a selected pressure from the opening and/or the port acting on the failure piston.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A borehole system having a tubing pressure insensitive failsafe wireline retrievable safety valve comprising:

a tool housing;

a flow tube disposed within the tool housing;

an actuation piston disposed in the tool housing and operably connected to the flow tube, the actuation piston having an actuation pressure side and a relatively lower pressure chamber side, the actuation pressure side being in pressure communication with an annular volume defined by an annular seal located outside of the tool housing; and a fluid pathway between a leak site of the annular seal and the relatively lower pressure chamber side of the piston.

* * * * *